US009685035B2

(12) United States Patent
Schattauer et al.

(10) Patent No.: US 9,685,035 B2
(45) Date of Patent: Jun. 20, 2017

(54) APPARATUS AND METHOD FOR A GAME WITH BLOCKADING GAME SYMBOLS

(71) Applicant: Novomatic AG, Gumpoldskirchen (AT)

(72) Inventors: Jurgen Schattauer, Huffelscheim (DE); Nicolas Kenessey, Bingen (DE)

(73) Assignee: Novomatic AG, Gumpoldskirchen (AT)

( * ) Notice: Subject to any disclaimer, the term of this patent is extended or adjusted under 35 U.S.C. 154(b) by 330 days.

(21) Appl. No.: 14/337,194

(22) Filed: Jul. 21, 2014

(65) Prior Publication Data

US 2015/0024827 A1 Jan. 22, 2015

Related U.S. Application Data

(60) Provisional application No. 61/856,782, filed on Jul. 22, 2013.

(51) Int. Cl.
*G07F 17/32* (2006.01)
*G07F 17/34* (2006.01)

(52) U.S. Cl.
CPC ..... *G07F 17/323* (2013.01); *G07F 17/326* (2013.01); *G07F 17/34* (2013.01)

(58) Field of Classification Search
CPC ..... G07F 17/323; G07F 17/326; G07F 17/34
See application file for complete search history.

(56) References Cited

U.S. PATENT DOCUMENTS

2004/0023714 A1* 2/2004 Asdale ..... G07F 17/3262 463/22
2009/0203415 A1* 8/2009 Falciglia, Sr. ..... A63F 1/00 463/11

* cited by examiner

*Primary Examiner* — Werner Garner
(74) *Attorney, Agent, or Firm* — Fincham Downs, LLC; Magdalena M. Fincham, Esq.

(57) ABSTRACT

An apparatus and method for a game of play for use in a casino establishment, or on a general purpose computing device for offering games with multiple outcomes and including blockading game elements or symbols. A base game, or an outcome on a base game that triggers a sub-game or a bonus game involves forming winning combinations from combinations of symbols in a matrix using only accessible symbol positions. Achieving winning combinations of symbols among accessible symbols results in awards to players. The apparatus and method are offered on electronic gaming machines such as slot machines and video poker machines, but may also be deployed on other devices such as on a general purpose computing device or mobile phone in stand-alone form or connected to a network, such as the internet.

22 Claims, 12 Drawing Sheets

APPARATUS AND METHOD FOR A GAME WITH BLOCKADING GAME SYMBOLS

RELATED APPLICATION INFORMATION

This application claims priority benefit from U.S. Provisional Patent Application Ser. No. 61/856,782, filed on Jul. 22, 2013, the entirety of which is incorporated by reference in the present application.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

Electronic gaming machines ("EGMs") offer a variety of games such as slot games, video poker games, roulette games, keno games and other types of wagering games that are commonly deployed at a casino for use by players. Play on the EGMs typically requires the player to place a wager on the outcome of the game. The games are programmed with a predefined set of outcomes including one or more winning outcomes and one or more losing outcomes. The player is awarded for a winning outcome and receives no award for a losing outcome.

Historically, the simple format of game play with a predefined set of outcomes has been appealing to players even though there are typically more losing outcomes than winning outcomes. However, game designers, players and operators of games are always striving to find appealing features and game functionality that will generate player excitement and increase, or at least maintain the interest of the player. Special awards, multipliers, bonus games and bonus features have become more and more popular in recent years as EGMs have grown more sophisticated, and players enjoy extending play with exciting new features and functionality.

The present invention defines an apparatus and method that adds excitement and a new form of entertainment to the play of wagering games. It does so by offering a fun and captivating game feature which may be implemented in a base game or a bonus game. Like other games played on an EGM, the player places an initial wager to play. A random number generator ("RNG") on the EGM generates an outcome and that outcome is displayed on the EGM display to the player. The invention may be implemented in a base game, a sub-game, a bonus or free spin game after a trigger in the base game, or in any combination where the game displays blockading game symbols positioned on the reels that are configured to generate wins among a combination of symbols in a group of "accessible" reel positions, but not using symbols located in "blockaded" reel positions. Unblocking game elements during play through winning combinations results in additional rounds of game play where more opportunities to create accessible winning combinations and resulting awards to players are possible.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION OF THE INVENTION

Figure 1:
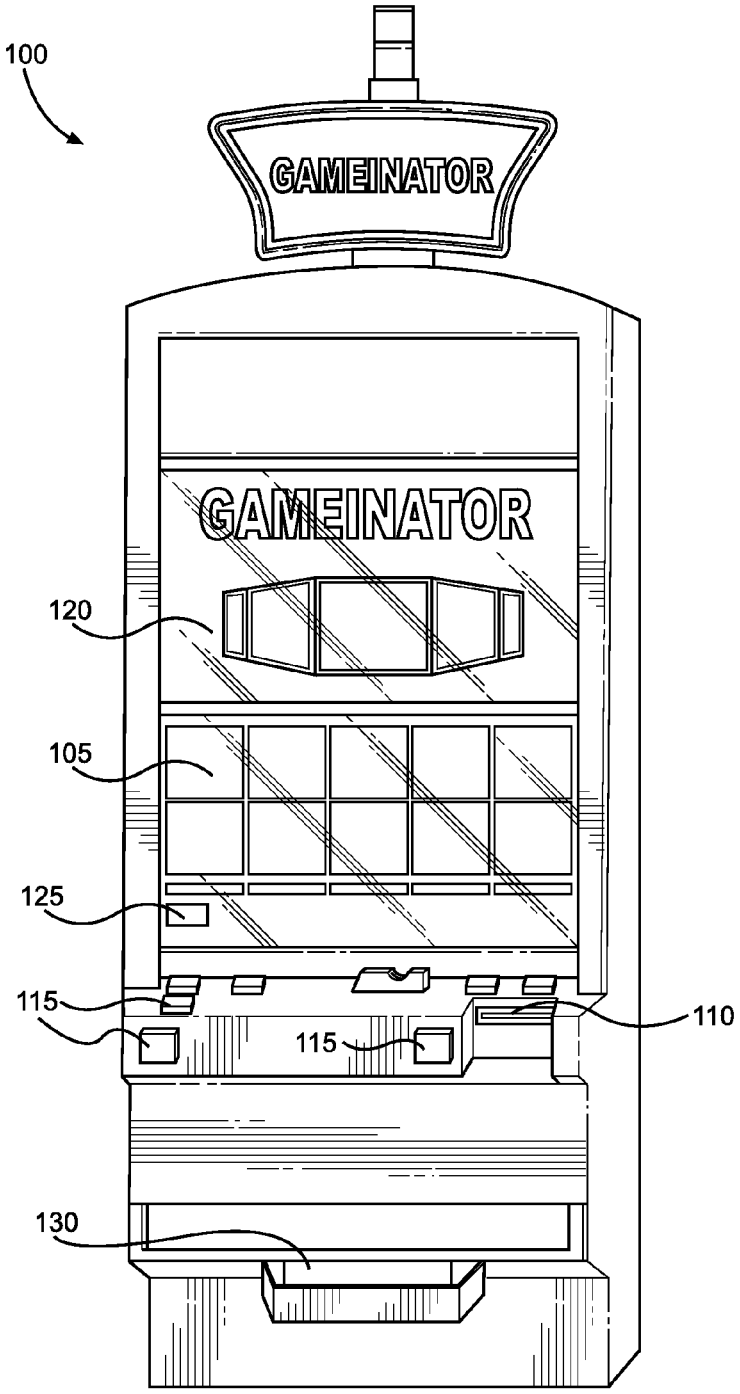
FIG. 1 Prior Art
FIG. 1 shows a prior art electronic gaming machine for playing a game.

The present invention will now be described more fully with reference to the accompanying drawings. It should be understood that the invention may be embodied in many different forms and should not be construed as limited to the embodiments set forth herein. Throughout FIGS. 1-7, like elements of the invention are referred to by the same reference numerals for consistency purposes.

FIG. 1 shows an electronic gaming machine ("EGM") 100 with a number of components. A primary display 105 is used to show game play and resulting outcomes, and may be in the form of a video display (shown), or alternatively, physical reels. Touch screen displays are included on most EGMs and provide a flexible interface for operation of EGM 100, including displaying symbols during game play. Other components include a bill validator (see FIG. 2A) housed inside EGM 100 into which bills may be inserted through bill slot 110. Buttons 115 on the exterior of EGM 100 are used to initiate and control EGM operations in conjunction with touch screen display 105 by the player. EGMs may further include a secondary display 120 for displaying other game functions including bonus screens. Either of primary display 105 or secondary display 120 may be used to show information to the player such as game play sequences, pay tables, messages, advertising, entertainment screens or other types of information. One or more meters 125 on display 105 are used for tracking credits available for play, amount won on a particular play, number of coins bet and other amounts. Meters 125 are typically positioned near the bottom of screen 105. EGM 100 may also accept coins. In those cases, a coin tray 130 at the bottom of EGM 100 is used to catch coins as they are dispensed to a player.

It is common for EGM 100 to include ticket-in, ticket-out ("TITO") capabilities that require a ticket reader and ticket printer housed inside of EGM 100 for accepting bar coded credits printed on a ticket through slot 110 and for which the value of the credits is displayed on meters 125 upon a ticket being inserted.

Figure 2A:
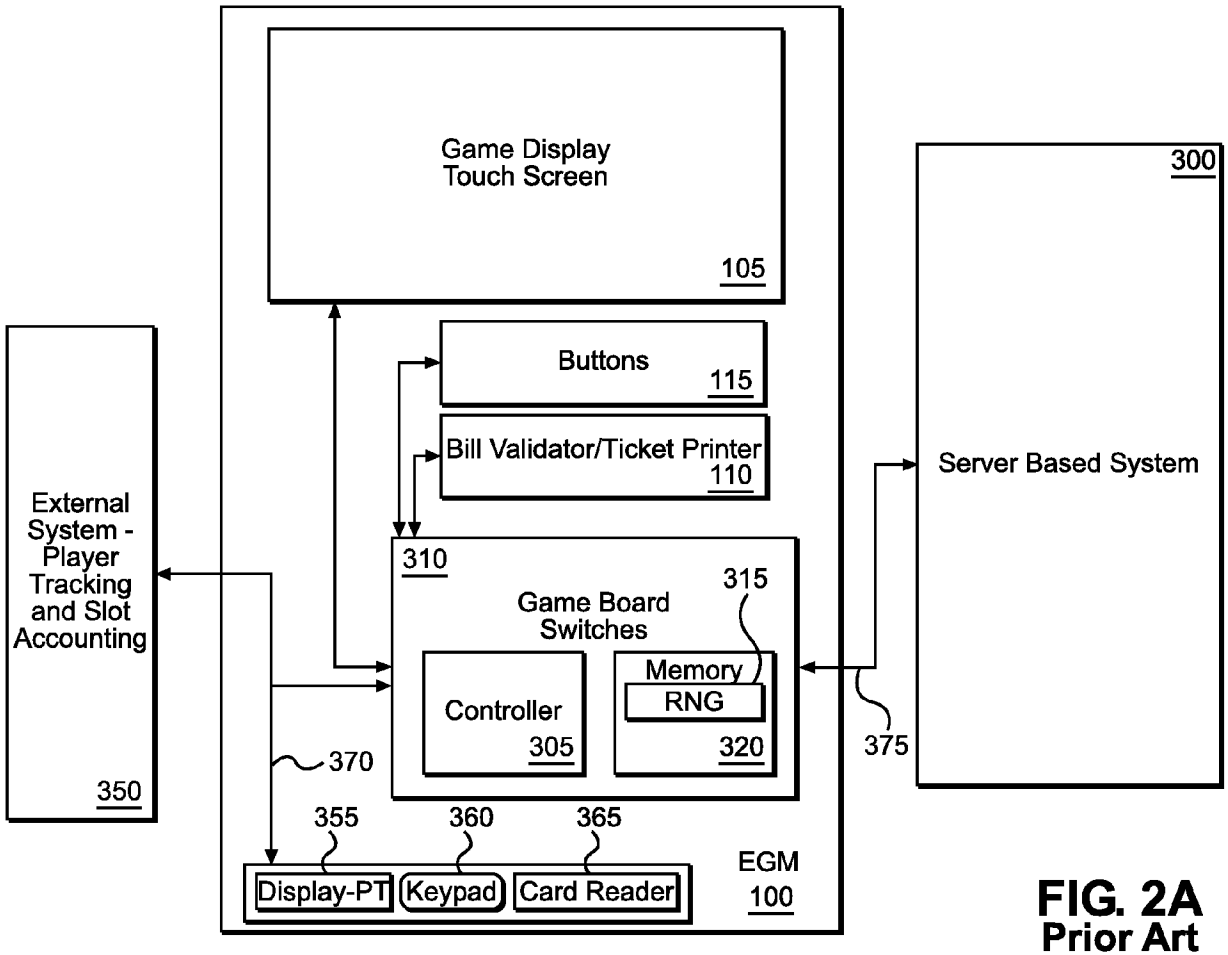
FIG. 2A Prior Art
FIG. 2A shows a prior electronic gaming machine for playing a game and connected to a network controlled by a server based system.

FIG. 2A is a block diagram of EGM 100 connected to a server based system 300 and showing certain internal components of EGM 100. All operational functions of EGM 100 are controlled by a controller 305 such as a microprocessor housed inside EGM 100 that is resident on a game board 310. The controller executes instructions that include operation of a random number generator 315 ("RNG") that is usually implemented in software and stored in a memory 320. The internal components of EGM 100 are well known to those of ordinary skill in the art. Game outcomes are determined based on the results corresponding to the numbers selected by RNG 315. A bill acceptor/validator 110 also has ticket printing capabilities. Bill validator 110 accepts currency in the form of bills or tickets from a player and adds credit to meter 125 on EGM 100.

An external system 350 such as a player tracking system, a slot accounting system or a bonusing system may also be connected to EGM 100. These types of systems are typically connected to EGM 100 either through a separate interface board (not shown) or directly integrated with the components of EGM 100 including but not limited to game board 310. A player tracking system may also include other components installed on EGM 100 such as a player tracking display 355, a keypad 360 and a card reader 365. These components allow for direct interaction between external system 350 and the player at EGM 100 to receive information from the player on keypad 360 or through information on a card inserted into card reader 365, and to display information to the player on display 355. A network is established between external system 350 and EGM 100 by network connection 370. The network may be connected to all EGMs 100 in a casino or any smaller subset of EGMs 100.

Server based system 300 is also connected to EGMs 100 by a network connection 375 which may be a separate connection or on a connection to the same network as external system 350. Server based system 300 may have one or more individual servers tasked with different functions such as communicating with a player at EGM 100 to fulfill requests, delivering services such as television shows or other content, or a host of other information.

In FIG. 2A, EGM 100 is shown as a casino gaming device of the type depicted in FIG. 1. It will be understood that the type of network 370, 375 over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network.

Figure 2B:
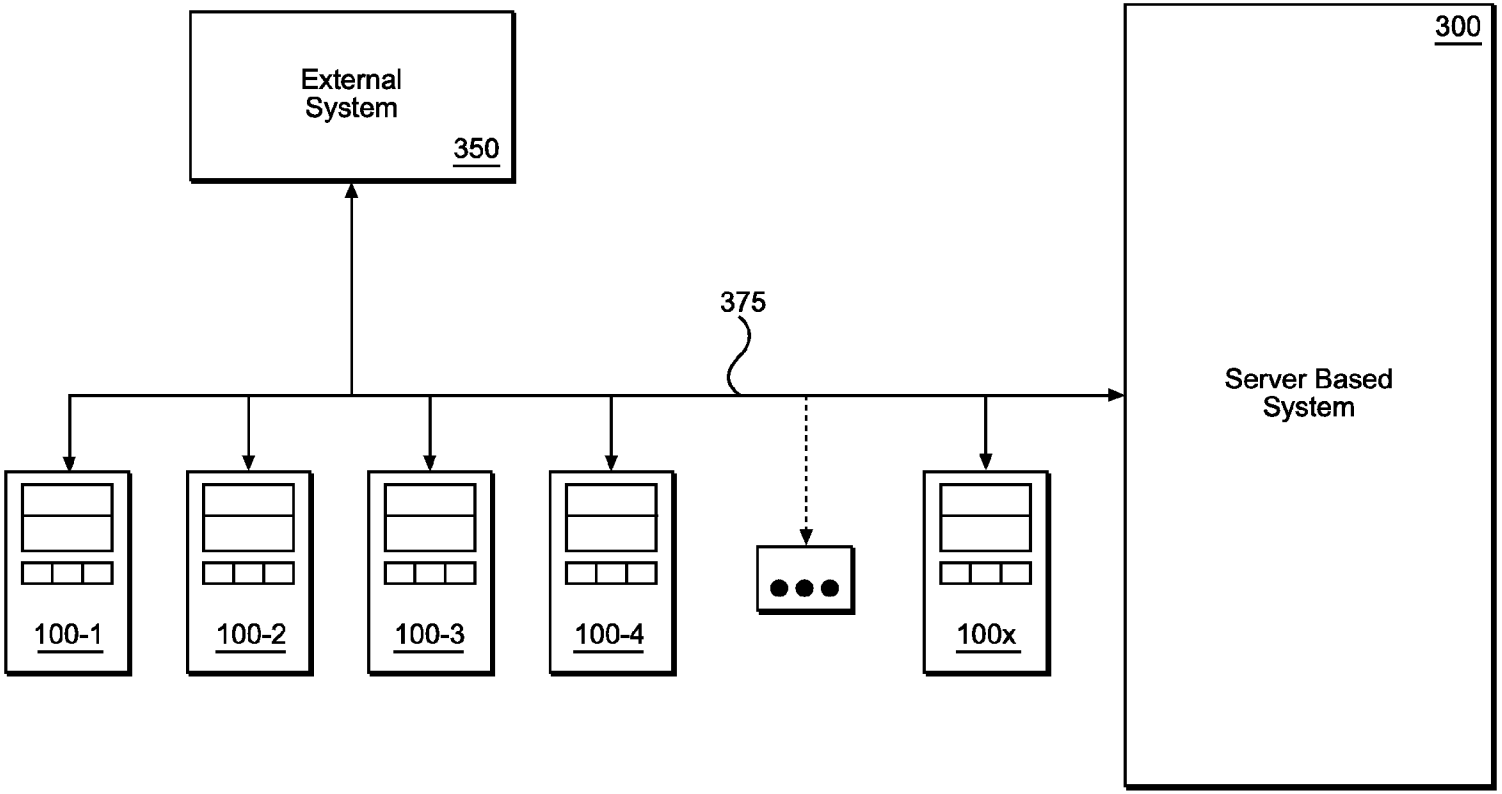
FIG. 2B Prior Art
FIG. 2B shows a group of prior art electronic gaming machines on a network connected to a server based system and an external system.

FIG. 2B is a block diagram showing a group of EGMs 100 1-*x* on a network connection 375 between server based system 300 and each of EGMs 100 1-*x*. It should be understood that the network may be set up with any number of EGMs that may number into the thousands of machines. Each of EGMs 100 1-*x* is also connected to external system 350 that may be a player tracking, slot accounting, bonusing or other type of system. Information is communicated between EGMs 100 and server based system 300.

Figure 2C:
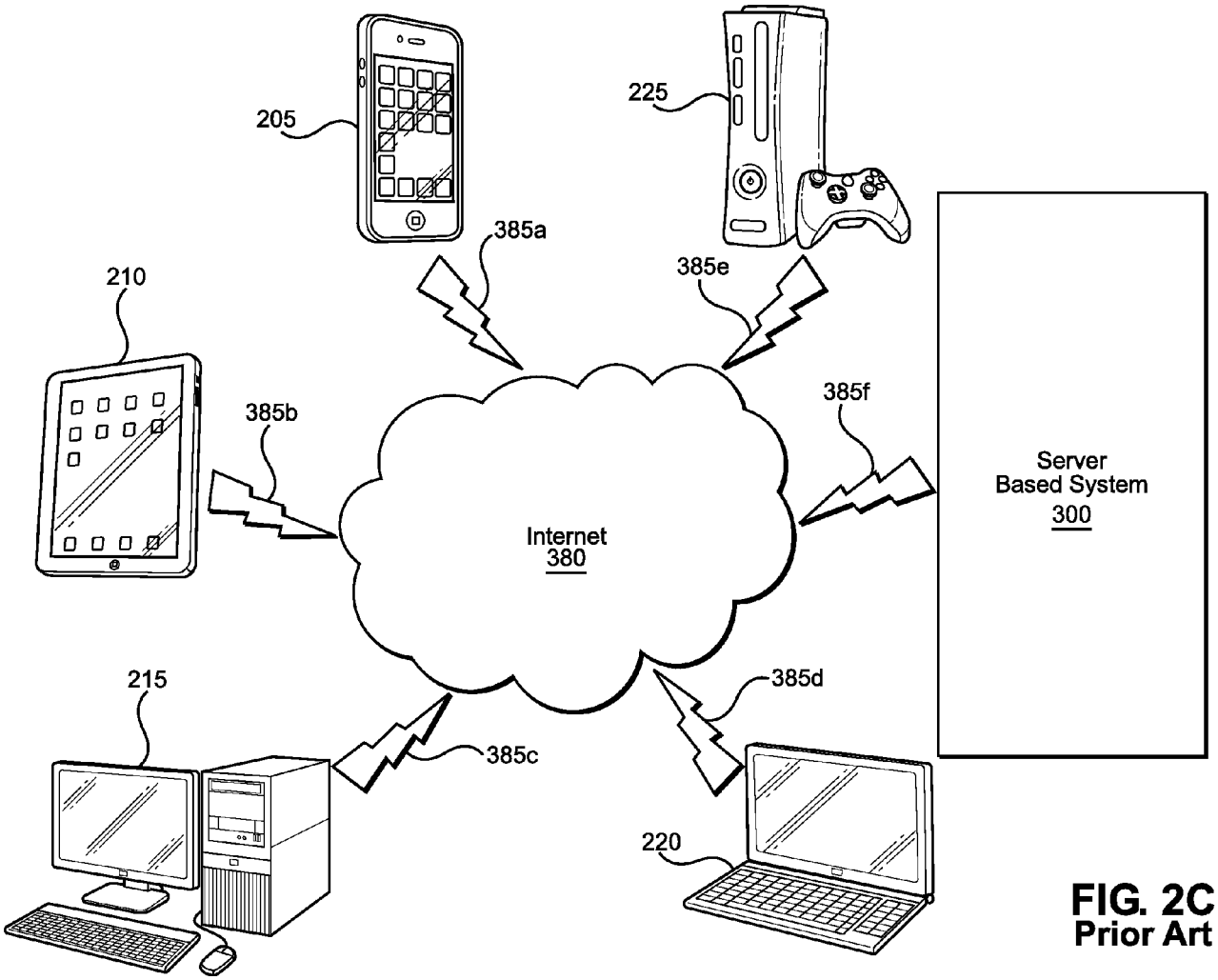
FIG. 2C Prior Art
FIG. 2C shows computing devices for playing a game, the devices optionally adapted to be on a network connected to a server based system.

FIG. 2C shows a number of general purpose computing devices which may be used to play a game. In particular, shown are: a smartphone 205 which may be an Apple iPhone 4S® as pictured, or any other mobile phone type device, a tablet computer 210 which may be an Apple iPad 3® as pictured, or any other tablet computing device, a desktop computer 215 which may be a Lenovo® machine as pictured, or any other desktop computer, a laptop computer 220 which may be a Lenovo® computer or any other laptop computer, and a home video gaming device 225 which may be a Microsoft Xbox® system or any other home video system. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on server based system 300 (See FIG. 2A) and then delivers the outcomes over the internet to be displayed on the general purpose computing device. It should also be understood that the game may be played for fun without a wager, or using promotional or "fun" credits that do not have monetary value. FIG. 2C further shows a server based system 300 connected to a network with multiple computing devices for playing games.

It should be understood that the network shown in FIG. 2C operates in a manner similar to the network of FIG. 2B, except that the computing devices on the network of FIG. 2C are preferably connected over the internet 380 with each device 205-225 connected over a secure connection 385*a*-*e* to server based system 300 which connects to the internet over network connection 385*f*. Payments can be made securely over internet 380 using connections 385*a*-*e*, and then delivered to an operator over connection 385*f*. Similarly, the game is executed on server based system 300 using a secure RNG with the outcomes being delivered to the individual devices 205-225 over internet 380. It should be understood that any one or more of the general purpose computing devices—smartphone 205, tablet computer 210, desktop computer 215, laptop computer 220, or home video gaming system 225 could be placed on a network connected to server based system 300 and used to deliver a game with blockading symbols. For purposes of this specification, reference to one or more EGMs 100 in an environment using a limited access intranet of the type typically found in a casino would also apply to one or more general purpose computing devices with a secure connection to a server over the internet and not involving a physical casino property at all, and which may or may not require a wager or payment to play. Alternatively, the game software or a portion of it may be resident and executed on each device 205-225. Wagers by players and payments to players may be made using accounts set up with an operator of a website on which the games are run.

For purposes of describing the operation and game flow of the invention, reference will be made to an EGM 100 as shown in FIG. 1. However, it will be understood that the game may be similarly implemented for operation and play by a user on any type of electronic device with capabilities for game play including but not limited to those shown in FIGS. 2A-2E.

Figure 3:
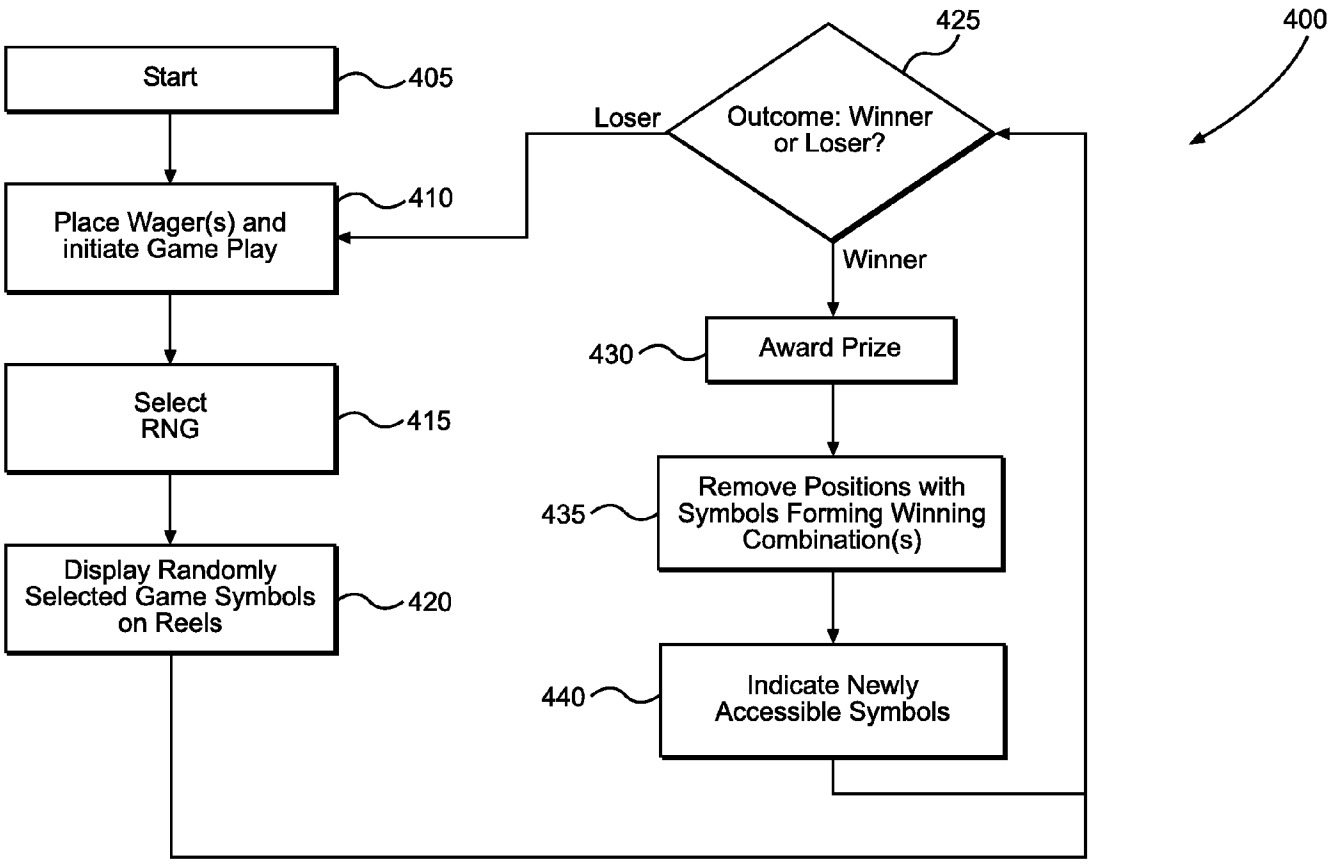
FIG. 3 shows a flow chart of game play where the player plays a game with symbols in blockading positions.

FIG. 3 shows a flow chart 400 of game play where the player plays a game with blockading symbols and implemented in a base game. The base game may use a group of reels in a matrix of columns and rows on touchscreen video display 105 as shown in FIGS. 4A-4E, or alternatively, on a set of physical reels or a combination of a set of physical reels superimposed by a transmissive touch screen video display. The description of the operation of the game will be provided with reference to both the flowchart of FIG. 3 and the screenshots in FIGS. 4A-4E.

The first step of game play on the base game is at start 405 which represents the point where a player sits down at EGM 100 to begin play. The player initially inserts a bill into bill slot 110 or coins into the coin head to load credits on EGM 100. These credits may be displayed to the player on credit meter 125. For purposes of this description, the base game will be a spinning reel slot game on video display 105 in which the player selects the number of lines to play and the number of coins per line which is indicated on a coins-per-line meter (not shown). A "total bet" which depends on the number of lines and the number of coins per line is indicated on total bet meter (not shown).

Figure 4A:
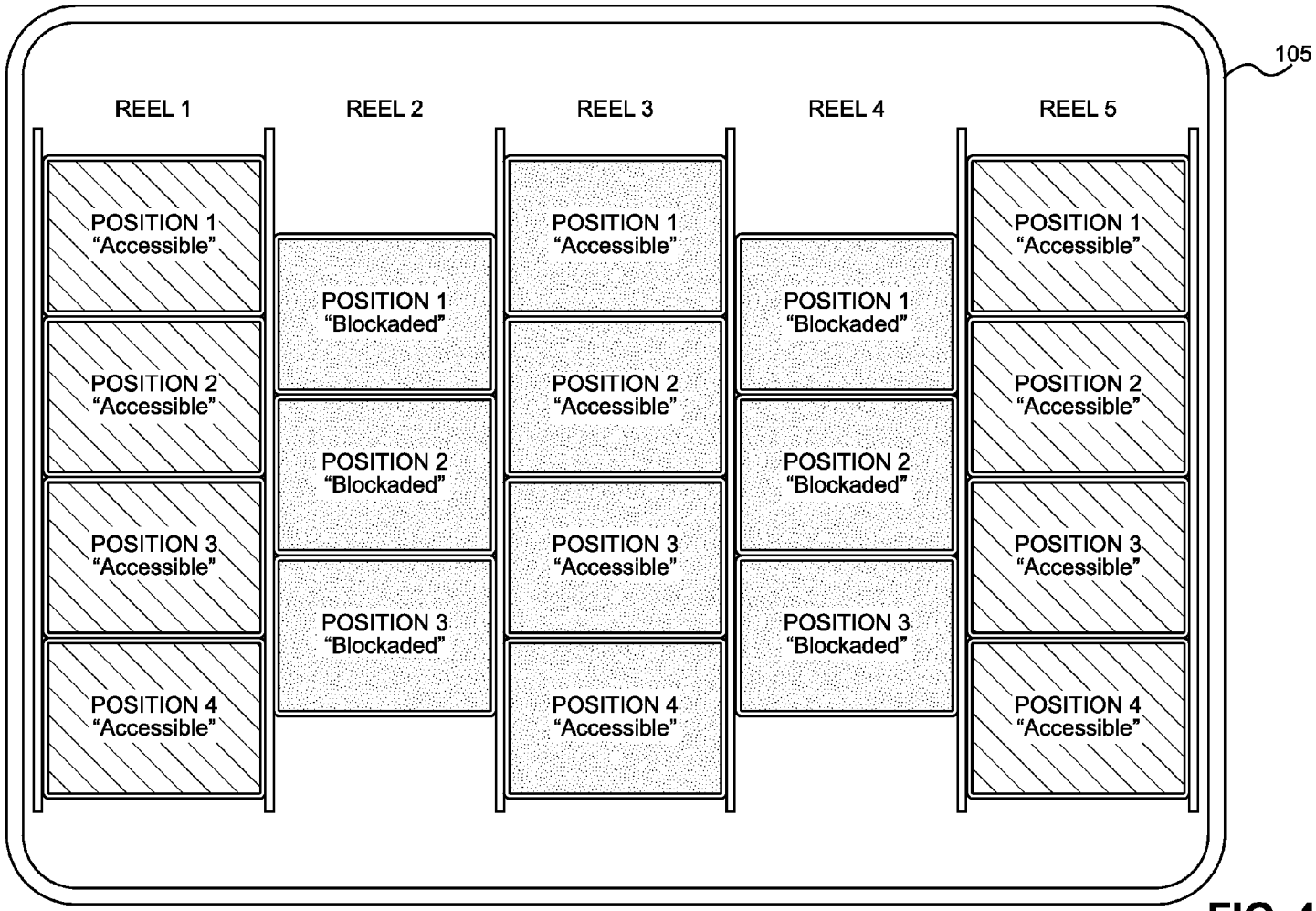
FIGS. 4A-E show illustrative screen shots of a game play sequence where the player plays a game with symbols in blockading positions.

The wager is placed and the game is started using buttons 115 to initiate game play at step 410. A game screen in FIG. 4A for the game shows the slot game with reels that display different blockading symbols on display 105. For purposes of this description, the reels will be formatted in a matrix of five vertical reels (columns). Symbols displayed on each reel are positioned in an offset configuration relative to each adjacent reel with each odd numbered reel having four positions and each even numbered reel having three positions. As an example, FIG. 4A depicts a configuration with four vertical positions in each of the three odd numbered reels (REEL 1, REEL 3 and REEL 5), and three vertical positions in each of the two even numbered reels (REEL 2 and REEL 4). From FIG. 4A, it is apparent that each position (POSITION 1, POSITION 2, POSITION 3 and POSITION 4) on the odd numbered reels (REEL 1, REEL 3 and REEL 5) are aligned. Similarly, the positions (POSITION 1, POSITION 2 and POSITION 3) on each of the even numbered reels (REEL 2 and REEL 4) are aligned. The offset alignment of the odd numbered reels to the adjacent even numbered reels as shown is preferred to create a more intricate blocking structure for the symbols displayed at each position as will become more readily apparent from the foregoing description. However, it should be understood that any sized matrix of columns and rows used on a set of reels would be suitable for implementing the invention. In fact, the matrix does not need to be symmetrical and the number of positions on the different reels may be different across the matrix. As an example, center REEL 3 may have four positions, REEL 2 and REEL 4 may have three positions, and REEL 1 and REEL 5 may have two positions with an offset alignment similar to that shown in FIG. 4A resulting in an overall diamond shape of the matrix. Furthermore, the positions in adjacent rows may be configured with or without an offset. The final layout for the design of the matrix is up to the game designer and will depend on the theoretical payback percentage as well as the game volatility desired.

Once game play is initiated at step 410, appropriate game graphics are shown on display 105 such as spinning reels, and corresponding game sounds come from speakers on EGM 100. At step 415, RNG 315 provides one or more random numbers and a game outcome is chosen. Once the outcome is reached, it is displayed in a matrix of positions each containing a randomly selected game symbol displayed on game display 105 for the player to see at step 420.

An important aspect of the game is that only symbols that are "unblocked" or "accessible" may be part of a winning combination of symbols. Unlike prior art games where paylines typically run horizontally across the symbol matrix with adjacent positions in each reel forming a payline, in the present game, winning combinations are formed on the periphery of the matrix by symbols located at positions that are accessible. These accessible symbols may also be referred to as unblocked or open. In FIG. 4A, accessible symbols are any of the symbols that are in REEL 1 or REEL 5. Blockaded symbols (also referred to as blocked or inaccessible symbols) are symbols in REEL 2, REEL 3 and REEL 4 because those symbols are not accessible from the sides, i.e. respective left or right hand side. In other words, those symbols are blockaded by symbols in an adjacent reel. Combinations of accessible symbols are available as a group to generate a winning combination.

Figure 4B:
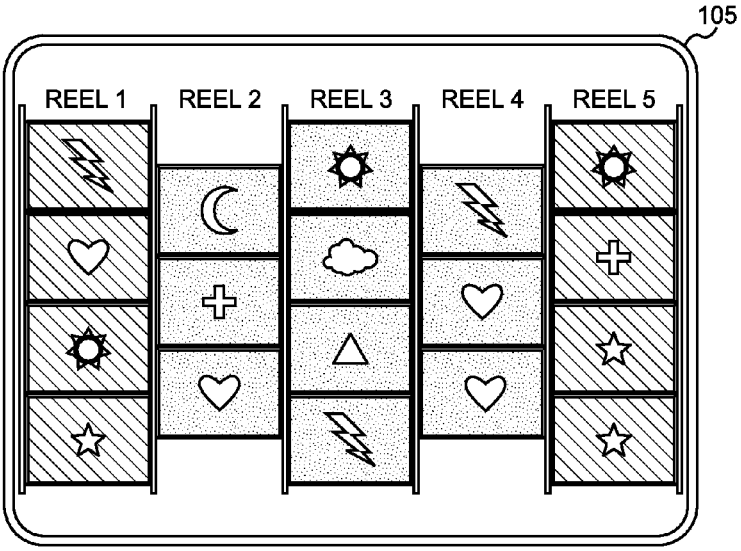

FIG. 4B shows the symbol matrix of FIG. 4A with randomly selected symbols in each position. The accessible symbols that are available to produce winning combinations are in REEL 1 and REEL 5. These symbols include: (1) LIGHTNING (REEL 1, POSITION 1); (2) HEART (REEL 1, POSITION 2); (3) SUN (REEL 1, POSITION 3); (4) STAR (REEL 1, POSITION 4); (5) SUN (REEL 5, POSITION 1); (6) PLUS (REEL 5, POSITION 2); (7) STAR (REEL 5, POSITION 3); and (8) STAR (REEL 5, POSITION 4). A game paytable defines winning combinations among the different symbols in the accessible matrix positions. As an example, a combination of three STARs and/or two SUNs may produce winning combinations that awards the player with a pay. Three STARs are included among the symbols in the accessible matrix positions at (REEL 1, POSITION 4), (REEL 5, POSITION 3) and (REEL 5, POSITION 4). In addition, two SUNs are included among the symbols in the accessible matrix positions at (REEL 1, POSITION 3) and (REEL 5, POSITION 1). At step 425, it is determined that two winning outcomes are achieved among the symbols in the accessible positions with the two winning outcomes being: (1) three STARs; and (2) two SUNs. To indicate these wins to the player, the three winning STARs or the boxes in which the STARs are positioned may be highlighted on display 105. Similarly, the two winning SUNs or the boxes in which the SUNs are positioned may be highlighted on display 105. Other on-screen indicators or sounds may be used to "celebrate" the win(s) or to notify the player of the win(s) and the winning combination(s).

Figure 4C:
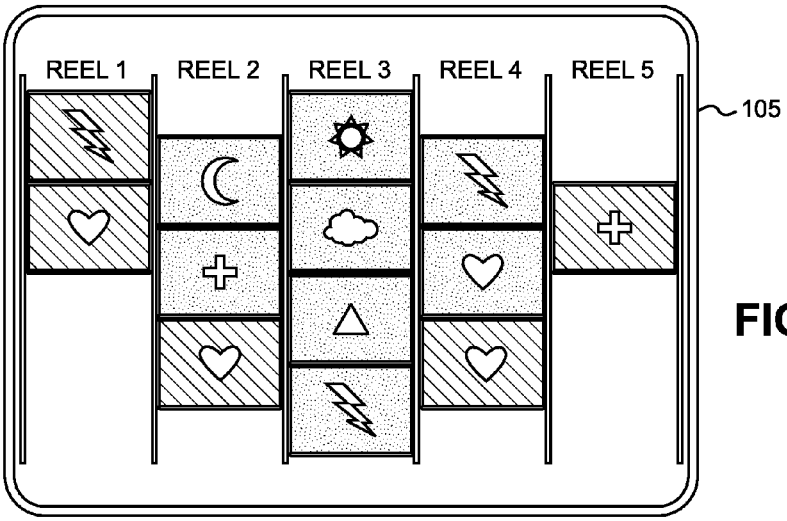

If no winning combinations are achieved among the accessible positions, the losing outcome results in the game ending at step 425 and the player is returned to step 410 to place a wager and initiate game play again. In the event that one or more winning combinations are achieved, such as the result in the example shown in FIG. 4B, the player is awarded a prize according to the paytable at step 430. The amount of the prize is shown on the win meter and added to the credit meter. Once the prize has been awarded, any positions in which symbols contributing to the winning combination(s) are located are then removed from the screen at step 435. FIG. 4C shows the resulting screenshot on display 105 in the game play sequence in which the positions where the three STARs and the two SUNs have been removed at step 435. Now that the winning symbols are removed, a new set of positions have become "accessible" providing additional opportunity to match up winning combinations of accessible symbols. In the screenshot of FIG. 4C, three HEARTs are now accessible thereby forming a new winning combination. The new accessible symbols are shown on display 105 at step 440 and play returns to step 425 where it is determined whether the new set of accessible symbols on display 105 includes any winning combinations.

In the case of the symbols shown in FIG. 4C, a new winning combination is formed from HEARTs shown at three positions in the remaining matrix: (1) (REEL 1, POSITION 2); (2) (REEL 2, POSITION 3); and (3) (REEL 4, POSITION 3). The win is then paid at step 430 and that amount is shown on the win meter and added to the credit meter. The win may be indicated to the player by highlighting the three HEARTs forming the winning combination and/or the positional boxes in which the HEARTs are located. Other on-screen indicators or sounds may be used to "celebrate" the win(s) or to notify the player of the win(s) and the winning combination(s).

Figure 4D:
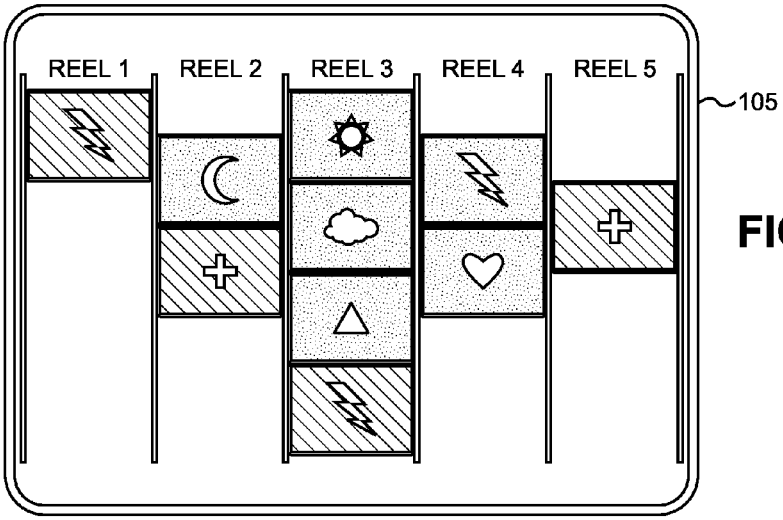
Figure 4E:
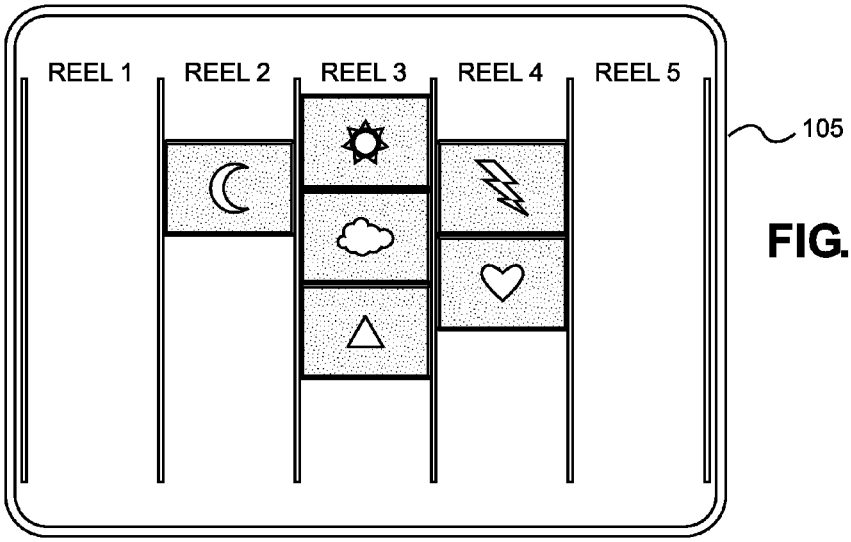

The process of removing winning symbols after each successive round continues until there are no winning symbol combinations available. In the screenshot of FIG. 4C, the three HEARTs are removed at step 440 and the resulting screenshot on display 105 is shown in FIG. 4D. As can be seen in FIG. 4D, two LIGHTNINGs and two PLUSes are accessible. In the event that a pair of any symbol or two pairs represent a winning combination according to the paytable, at step 425 it is determined that another win has occurred. The player is again awarded a prize at step 430 and the winning symbols are removed at step 435 to indicate the next screenshot on display 105 at step 440 as shown in FIG. 4E. Since there are no winning combinations in the symbol matrix of FIG. 4E, play proceeds from step 425 where it is determined to be a loser and moves directly back to step 410 exiting the symbol removal and replay loop of steps 425, 430, 435 and 440.

Figure 5A:
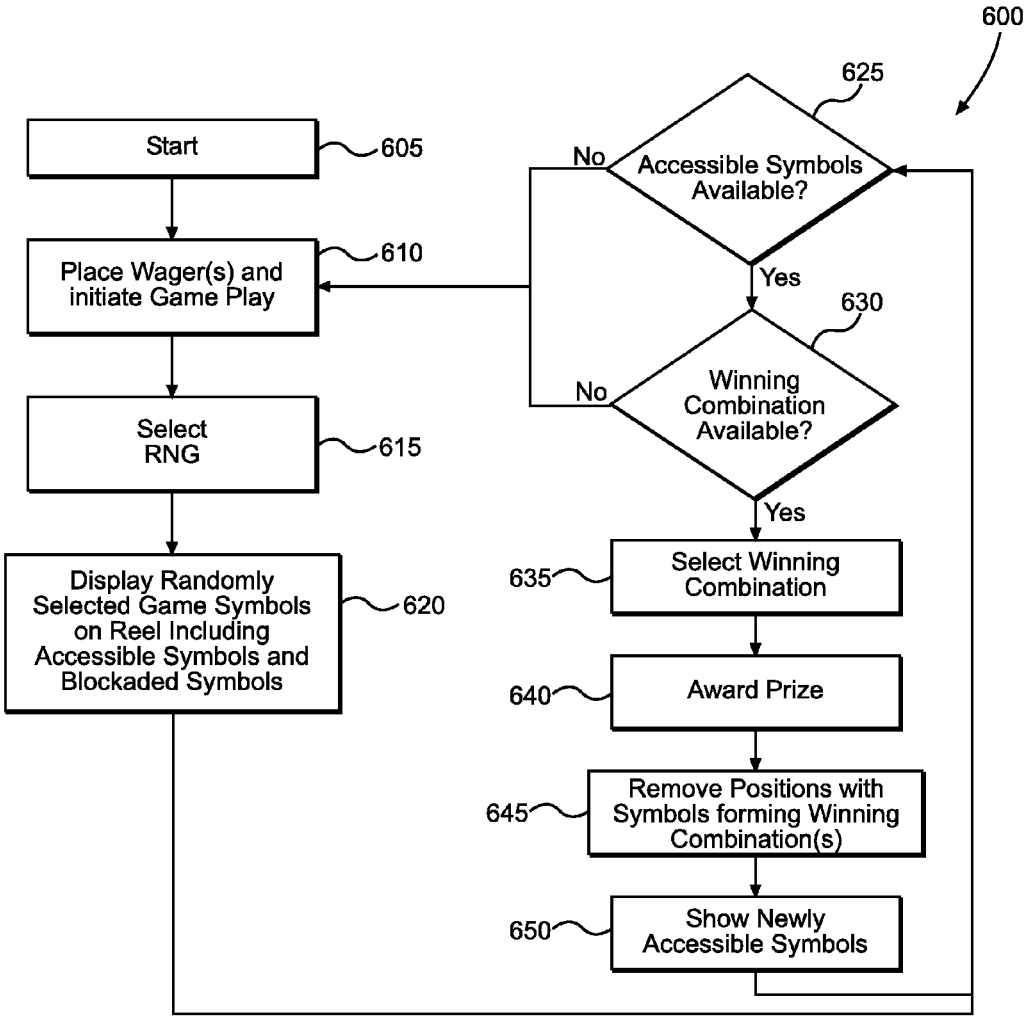
FIGS. 5A-B show a flow chart of alternative game play where the player plays a game with symbols in blockading positions.
Figure 5B:
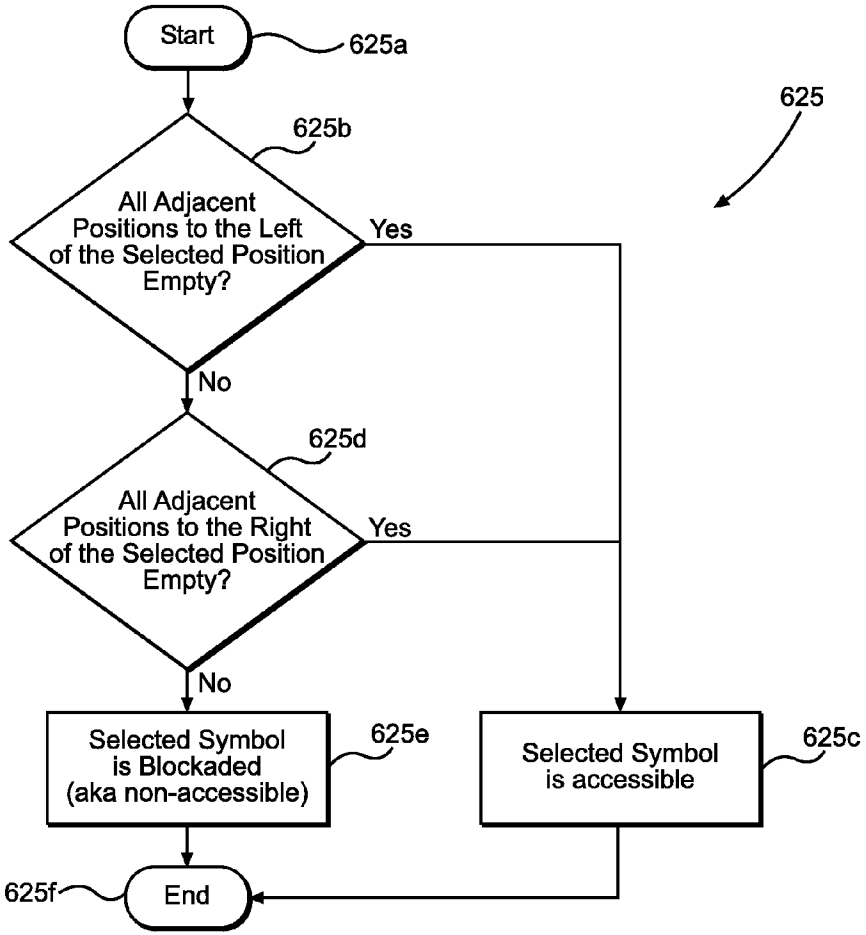

FIGS. 5A-5B show a flow chart 600 of an alternative game play sequence where the player plays a game with blockading symbols and implemented in a base game. The base game may use a group of reels in a matrix of columns and rows on touchscreen video display 105 as shown in FIGS. 6A-6F, or alternatively, on a set of physical reels or a combination of a set of physical reels superimposed by a transmissive touch screen video display. The description of the operation of the game will be provided with reference to both the flowchart of FIGS. 5A-5B and the screenshots in FIGS. 6A-6F.

The first step of game play on the base game is in flowchart 600 at start 605 which represents the point where a player sits down at EGM 100 to begin play. The player initially inserts a bill into bill slot 110 or coins into the coin head to load credits on EGM 100. These credits may be displayed to the player on credit meter 125. For purposes of this description, the base game will be a spinning reel slot game on video display 105 in which the player selects the number of lines to play and the number of coins per line which is indicated on a coins-per-line meter (not shown). A "total bet" which depends on the number of lines and the number of coins per line is indicated on total bet meter (not shown).

Figure 6A:
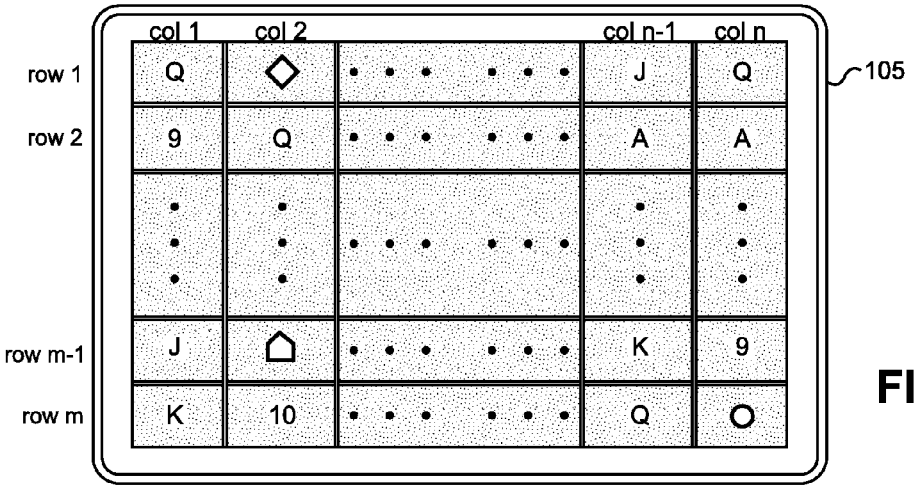
FIGS. 6A-6F show illustrative screen shots of an alternative game play sequence where the player plays a game with symbols in blockading positions.

The wager is placed and the game is started using buttons 115 to initiate game play at step 610. A game screen in FIG. 6A for the game shows the slot game with reels that display different blockading symbols on display 105. For purposes of this description, the reels will be formatted in a matrix of m vertical reels (columns) with each reel having n horizontal positions making up a row, each row which may also be a payline. As an example, FIG. 6A depicts an m×n matrix with row 1 having a "Q" (row 1; column 1), a "◇" (1:2), a "J" (1:n−1), and a "Q" (1:n). The symbols for each of the reels or columns situated between REEL 2 and REEL n−1 are not shown and are represented by " . . . " to indicate that any number of reels may be in play. Further, the symbols in adjacent rows of this alternative embodiment are configured without an offset as shown in the matrix configuration of FIGS. 4A-4E.

Once game play is initiated at step 610, appropriate game graphics are shown on display 105 such as spinning reels, and corresponding game sounds come from speakers on EGM 100. At step 615, RNG 315 provides one or more random numbers and a game outcome is chosen. Once the outcome is reached, it is displayed in a matrix of positions each containing a randomly selected game symbol displayed on game display 105 for the player to see at step 620.

An important aspect of the game is that only symbols that are "unblocked" or "accessible" may be part of a winning combination of symbols. Unlike prior art games where paylines typically run horizontally across the symbol matrix with adjacent positions in each reel forming a payline, in the present game, winning combinations are formed on the periphery of the matrix by symbols located at positions that are accessible. These accessible symbols may also be referred to as unblocked or open. In FIG. 6A, accessible symbols are any of the symbols that are in REEL 1 (column 1) or REEL n (column n). Blockaded symbols (also referred to as blocked or inaccessible symbols) are symbols in REEL 2, REEL 3, and any other inside reels through REEL n−1 because those symbols are not accessible from the sides, i.e. respective left or right hand side. In other words, those symbols are blockaded by symbols in an adjacent reel. Combinations of accessible symbols are available as a group to generate a winning combination.

Figure 6B:
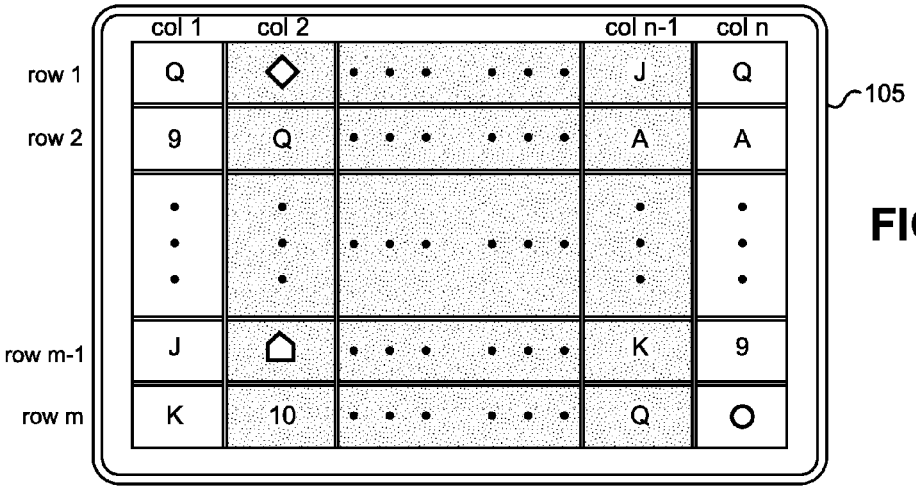

FIG. 6B shows the symbol matrix of FIG. 6A with symbols in different positions. The accessible symbols that are available to produce winning combinations are highlighted in REEL 1 and REEL n. These symbols include: (1) Q (REEL 1, ROW 1); (2) 9 (REEL 1, ROW 2); (3) J (REEL 1, ROW m−1); and (4) K (REEL 1, ROW m). Each of the positions in REEL 1 (also referred to as column 1) between row 2 and row m−1 are also accessible. These positions are indicated as " . . . " to show that the matrix may be of any size as determined by the game designer. A game paytable defines winning combinations among the different symbols in the accessible matrix positions. As an example, the game shown uses a set of symbols including common playing card denominations that include Aces, Kings, Queens, Jacks and number cards 1-10 along with other symbols. As is common in video wagering games of different types, a combination of cards such as a pair of Queens ("Q"), a pair of Jacks ("J") or a pair of numbered cards such as 9s may produce winning combinations that awards the player with a pay. At step 625, it is determined that two winning outcomes are achieved among the symbols in the accessible positions with the two winning outcomes being: (1) two Qs; and (2) two 9s. To indicate these wins to the player, the winning Qs or the boxes in which the Qs are positioned may be highlighted on display 105. Similarly, the two winning 9s or the boxes in which the 9s are positioned may be highlighted on display 105. Other on-screen indicators or sounds may be used to "celebrate" the win(s) or to notify the player of the win(s) and the winning combination(s).

Figure 6C:
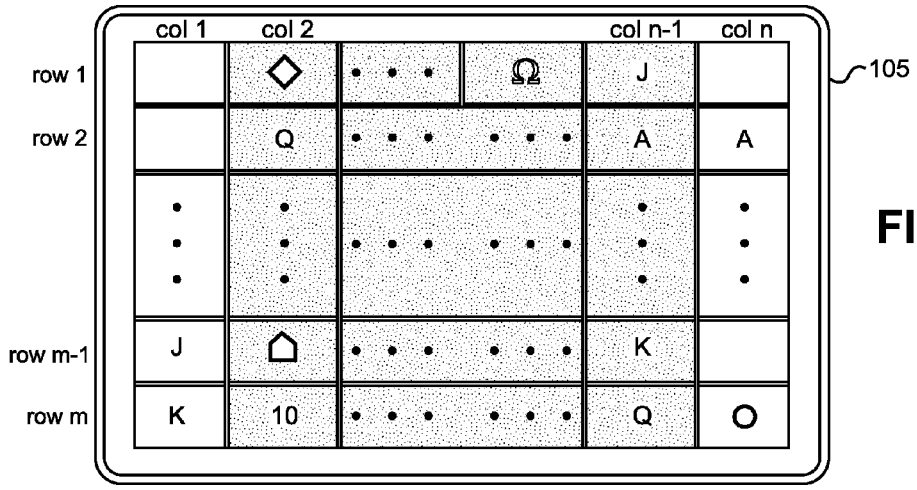

If no winning combinations are achieved among the accessible positions, the losing outcome results in the game ending at step 625 and the player is returned to step 610 to place a wager and initiate game play again. It should be understood, that any symbol combinations occurring on a payline of the game may be awarded separately as a standard win as part of standard game play independent of the evaluation of accessible symbols forming winning combinations. Or, the game may be configured without standard play and in that case the only way to achieve a win is through achieving a winning combination in accessible positions. In the event that one or more winning combinations are available to a player among the accessible positions as indicated at step 630, such as the result in the example shown in FIG. 6B, the winning combination or combinations are selected at step 635 and the prize is awarded at step 640 according to the paytable. The amount of the prize is shown on the win meter and added to the credit meter. Once the prize has been awarded, any positions in which symbols contributing to the winning combination(s) are located are then removed from the screen at step 645. FIG. 6C shows the resulting screenshot on display 105 in the game play sequence in which the positions where the two Qs and the two 9s have been removed at step 645. Now that the winning symbols are removed, a new set of positions have become "accessible" providing an additional opportunity to match up winning combinations of accessible symbols. In the screenshot of FIG. 6C, the positions that were formerly occupied by the Qs and 9s are now open, leaving positions in REEL 2 and REEL n−1 accessible. The new accessible symbols are shown on display 105 at step 650 and play returns to step 625 where it is determined whether the matrix with prior winning combinations removed has any newly accessible symbols available by returning to step 625. If so, the new set of accessible symbols on display 105 are evaluated to determine whether the new set includes any winning combinations at step 630.

Figure 6D:
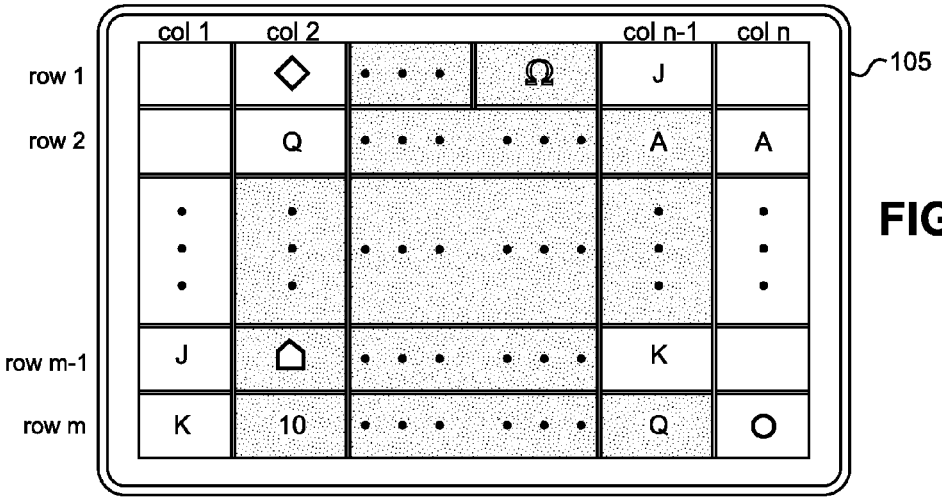

In the case of the newly accessible symbols highlighted in FIG. 6D, a new winning combination is formed from Ks shown at two positions in the matrix: (1) (REEL 1, POSITION m); and (2) (REEL n−1, POSITION m−1). Also on FIG. 6D, a second winning combination is now available with accessible symbols in the form of two Js at (REEL 1, POSITION m−1) and (REEL n−1, POSITION 1). The combinations are selected at step 635 and wins for the two pairs are paid at step 640. The amount paid is shown on the win meter and added to the credit meter. The win may be indicated to the player by highlighting the two Ks and the two Js forming the winning combination and/or the positional boxes in which the Ks and Js are located. Other on-screen indicators or sounds may be used to "celebrate" the win(s) or to notify the player of the win(s) and the winning combination(s).

Figure 6E:
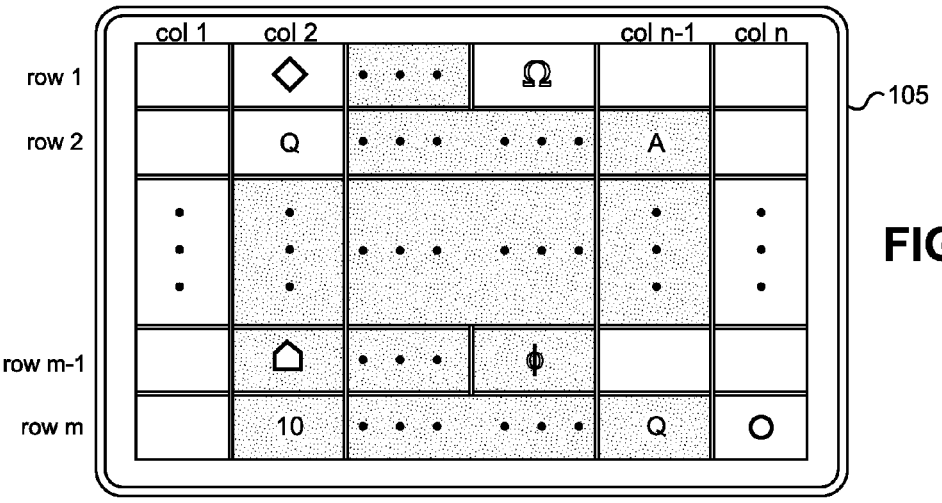
Figure 6F:
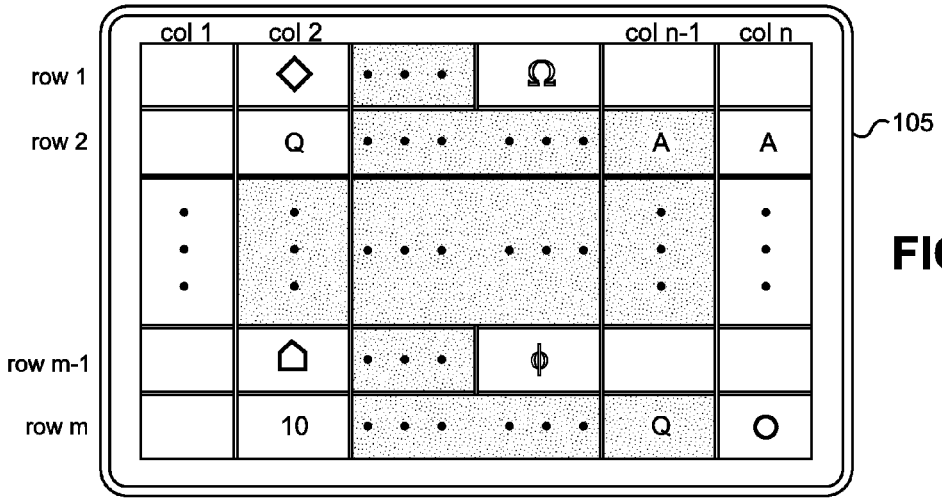

The process of removing winning symbols after each successive round continues until there are no winning symbol combinations available. In the screenshot of FIG. 6D, the two Ks and the two Js are removed at step 645 and the resulting screenshot on display 105 is shown in FIG. 6E. Once the winning symbols are removed, newly accessible symbols include a 10 at REEL 2 (row m), a ⌂ at REEL 2 (row m−1), and a Φ at REEL n−2 (row m−1) as can be seen in FIG. 6F and that are highlighted. Since there are no winning combinations in the symbol matrix of FIG. 6F, play returns to step 625 where it is determined that no accessible symbols are available. From there, play moves directly back to step 610 exiting the replay loop of steps 630, 635, 640, 645 and 650.

FIG. 5B is a flowchart that shows a set of substeps of step 625 described in FIG. 5A for determining whether any accessible symbols are available. In the embodiment of FIGS. 4A-4E, all the symbol positions are defined as initially blockaded positions with the exception of outer REEL 1 and outer REEL 5 that are defined as the initially accessible positions. In the embodiment of FIGS. 6A-6F, all of the symbols are defined as initially blockaded positions except outer REEL 1 and outer REEL n.

As winning combinations are formed in the accessible positions, newly accessible positions are opened up to the interior positions that are adjacent and to the right of a removed winning symbol in REEL 1 or adjacent and to the left of a removed winning symbol in REEL n−1 as the steps of the flowchart in FIG. 5A are performed. As the winning symbols are removed, additional symbols become accessible as exemplified in FIGS. 4A-4E and 6A-6F.

The subprocess of FIG. 5B starts at step 625*a*. Once the subprocess is underway, it is determined whether all adjacent positions to the left of the selected position are empty at step 625*b*. If yes, the selected symbol is determined to be accessible at step 625*c*. In a further embodiment it may be defined or checked that in case there is no adjacent position to the selected position, e.g. in case the selected position is the outmost position respectively positioned at the edge of the matrix or reel, then the selected position symbol is determined to be accessible. If the selected symbol in step 625*b* is not determined to be accessible in step 625*b*, the subprocess proceeds to determine whether all adjacent positions to the right of the selected position are empty at step 625*d*. If it is determined that all adjacent positions to the right of the selected position are empty, the process proceeds to step 625*c* where the selected symbol is determined to be accessible. If instead, all adjacent positions to the right of the selected position are not empty at step 625*d*, then the symbol is determined to be blockaded at step 625*e*. The subprocess then ends at step 625*f*. It should be understood that the game may be designed with the matrix configured so that the methodology of sequencing blockaded and accessible positions is different than as described. For example, the initially accessible symbols may be in ROW 1 and ROW m. And then, the accessible positions may proceed into the interior rows from above and below.

Figure 7:
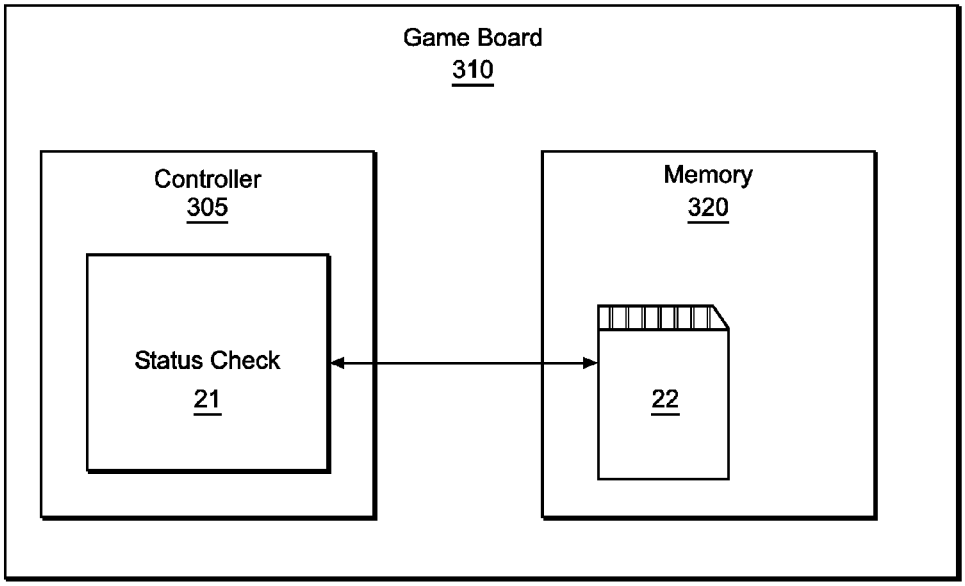
FIG. 7 shows details of the game board of the electronic gaming machine according to an embodiment of the invention.

According to an embodiment, FIG. 7 shows that controller 305 performs status checking 21 in conjunction with a first memory area 22 (having a number of memory cells) of memory 320. For each of the symbol positions shown in FIGS. 6A-6F, first memory area 22 stores data indicating whether the position is accessible (=logic "1") or blockaded (=logic "0"). In other words, each memory cell of first memory area 22 corresponds to a respective symbol position of the symbol matrix. Status check 21 is provided and adapted to check and/or amend in a read/write operation the memory cells of first memory area 22 representing status information of a respective (matrix) symbol as being blocked/accessible as described in the context of FIG. 5B.

It should be understood that the blockading game play as described and shown in FIGS. 3-6 is illustrative only. It is possible to configure blockading and accessible positions in different ways. For example, in a rectangular matrix without offset between adjacent reels, any position around the outside of the matrix may be set as "accessible." Alternatively, a group of positions at the inside portion of the matrix could be chosen to be accessible and then with each successive round of winning combinations, additional blockaded symbols may be accessible from the inside out.

In an alternative implementation, the operation and game play may be used in a bonus round that is triggered during game play in a base game on any type of game, including slot games of the physical reel or video type, poker, keno, roulette, craps or any other type of game on an electronic gaming device of the type shown in FIG. 1, as well as any other type of game that may be played on any of the devices shown in FIGS. 2A-2C. The bonus trigger may present itself in a number of different ways during the base game, including but not limited to: 1) achieving a pre-defined symbol combination lined up on the payline or elsewhere on the reels such as in a scatter pay that is well known to those in the art of slot machine design; 2) expiration of a pre-defined time period measured by EGM 100 or server 300; 3) expiration of a randomly selected time-period calculated by EGM 100 or server 300; 4) reaching a pre-defined or random dollar threshold value collected by one or more EGMs 100; 5) providing a customer loyalty program award; or 6) any other mechanism for moving into a bonus or secondary game. The bonus game would follow the same steps of operation as shown for the base game in FIG. 3 and as illustrated in the screenshots of FIGS. 4A-4E, or alternatively for the base game in FIGS. 5A-5B and as illustrated in the screenshots of FIGS. 6A-6F.

As an alternative to providing credits for winning combinations of accessible game elements, a bonus round version of the game may be set to provide a multiplier to the player that multiplies the credits awarded for a winning combination on the base game. As another alternative to providing credits or a multiplier for achieving winning combinations of accessible symbols, free spins may be provided to the player.

While the invention has been described with respect to the figures, it will be appreciated that many modifications and changes may be made by those skilled in the art without departing from the spirit of the invention. For example, the game may be implemented as a free play game in which it is not necessary to place a wager. Or, it is possible to remove all accessible symbols after a round even if one or more of such symbols is not part of a winning combination. It is also possible to include one or more special symbols that are automatically considered accessible in the matrix, or that create an accessible zone around them in one or more directions. Further, a player may be awarded a special prize for removing all symbols in the matrix through the successive rounds of play. Any variation and derivation from the above description and drawings are included in the scope of the present invention as defined by the claims.

What is claimed is:

1. An electronic gaming machine ("EGM"), comprising:

(a) a random number generator ("RNG") for generating random numbers that determine an outcome of a game and that correspond to a predefined set of game outcomes including winning and losing outcomes;

(b) a display for displaying game play including at least a subset of the predefined set of game outcomes;

(c) a physical payment acceptor operable to receive a first physical item representing a first monetary amount;

(d) a dispensing mechanism for dispensing a second physical item representing a second monetary amount; and (e) a controller operable to communicate with the RNG, the display, the physical payment acceptor and the dispensing mechanism in order to facilitate the game by:

(i) updating, based on receiving an indication that the first physical item representing the first monetary amount has been input to the physical payment acceptor, a credit balance of funds available for wagering;

(ii) receiving, after the updating, an input initiating the game and deducting an appropriate wager amount from the credit balance based on the input;

(iii) receiving, in response to the initiating, at least one random number from the RNG and controlling the game play on the EGM to provide a plurality of symbols positioned in a matrix of positions, each particular symbol being displayed in a manner visible to a player of the game and positioned in the matrix wherein a first subgroup of symbols is categorized as blockaded despite being visible and wherein a second subgroup of symbols is accessible, wherein the matrix comprises a plurality of paylines along which winning combinations of symbols may be positioned and further wherein only symbols deemed to be accessible symbols are included in a determination of whether a winning combination of symbols has been formed along a particular payline;

(iv) wherein, if at least one first level winning combination of at least two symbols is formed from the second subgroup, providing a first notification of a first level win and removing the at least two symbols forming the at least one first level winning combination of the at least two symbols from the matrix on the display to form a first new set of accessible symbols from a combination of any remaining accessible symbols from the second subgroup and newly accessible symbols from the first subgroup;

(v) wherein, if at least one second level winning combination of symbols is formed from the first new set of accessible symbols, providing a second win notification of the at least one second level winning combination of symbols; and (vi) instructing the dispensing mechanism to dispense the second physical item upon receiving a request from the player to cash out the credit balance.

2. The EGM of claim 1 wherein, if the at least one second level winning combination of symbols is formed from the first new set of accessible symbols, removing symbols forming the at least one second level winning combination of symbols from the matrix on the display to form a second new set of accessible symbols from a combination of any remaining accessible symbols from the second subgroup and any additional newly accessible symbols from the first subgroup; and further wherein, if at least one third level winning combination of symbols is formed from the second new set of accessible symbols, providing a third win notification.

3. The EGM of claim 1 wherein the matrix comprises at least three reels.

4. The EGM of claim 3 wherein rows of symbols in adjacent reels are configured in an offset alignment relative to each other.

5. The EGM of claim 1 wherein the accessible symbols are positioned at an outside periphery of the matrix and are not adjacent to any other symbol along any portion of at least one side of a position.

6. The EGM of claim 1 wherein the game comprises a base game in which the operational steps of (iii) through (v) are performed as part of the base game.

7. The EGM of claim 1 wherein the game comprises a base game and a bonus game configured such that the operational steps of (iii) through (v) are performed as part of the bonus game.

8. The EGM of claim 1 wherein all accessible symbols in the second subgroup are removed in step (iv).

9. The EGM of claim 1 further comprising at least one accessible special symbol in the plurality of symbols that provides an automatically accessible zone for one or more of the symbols comprising: (a) the at least one accessible special symbol itself; (b) a symbol that is in a predefined position relative to the at least one accessible special symbol; (c) more than one symbol that are in predefined positions relative to the at least one accessible special symbol; or (d) any combination of (a), (b) and/or (c).

10. The EGM of claim 1 wherein at least one of the at least one first level winning combination of at least two symbols and the at least one second level winning combination of symbols results in any of the group comprising: (a) a multiplier applied to a win; (b) a free spin awarded; (c) extended play awarded; (d) a bonus awarded; or (e) any combination of (a), (b), (c) and/or (d).

11. The EGM of claim 1 wherein the player engages in game play through successive rounds to eliminate all symbols in the matrix.

12. A method of playing a game on an electronic gaming machine ("EGM") having a controller that receives random numbers from a random number generator ("RNG"), a display, a physical payment acceptor operable to receive a first physical item representing a first monetary amount, and a dispensing mechanism for dispensing a second physical item representing a second monetary amount, wherein the controller is operable to communicate with the RNG, the display, the physical payment acceptor and the dispensing mechanism in order to facilitate the game by performing the method comprising the steps of:

(i) updating, based on receiving an indication that the first physical item representing the first monetary amount has been input to the physical payment acceptor, a credit balance of funds available for wagering;

(ii) receiving, after the updating, an input initiating the game and deducting an appropriate wager amount from the credit balance based on the input;

(iii) receiving, in response to the initiating, at least one random number from the RNG and controlling the game play on the EGM to provide a plurality of symbols positioned in a matrix of positions, each particular symbol being displayed in a manner visible to a player of the game and positioned in the matrix wherein a first subgroup of symbols is categorized as blockaded despite being visible and wherein a second subgroup of symbols is accessible, wherein the matrix comprises a plurality of paylines along which winning combinations of symbols may be positioned and further wherein only symbols deemed to be accessible symbols are included in a determination of whether a winning combination of symbols has been formed along a particular payline;

(iv) wherein, if at least one first level winning combination of at least two symbols is formed from the second subgroup, providing a first notification of a first level win and removing the at least two symbols forming the at least one first level winning combination of the at least two symbols from the matrix on the display to form a first new set of accessible symbols from a combination of any remaining accessible symbols from the second subgroup and newly accessible symbols from the first subgroup;

(v) wherein, if at least one second level winning combination of symbols is formed from the first new set of accessible symbols, providing a second win notification of the at least one second level winning combination of symbols; and (vi) instructing the dispensing mechanism to dispense the second physical item upon receiving a request from the player to cash out the credit balance.

13. The method of claim 12 wherein, if the at least one second level winning combination of symbols is formed from the first new set of accessible symbols, removing symbols forming the at least one second level winning combination of symbols from the matrix on the display to form a second new set of accessible symbols from a combination of any remaining accessible symbols from the second subgroup and any additional newly accessible symbols from the first subgroup; and further wherein, if at least one third level winning combination of symbols is formed from the second new set of accessible symbols, providing a third win notification of a third level win.

14. The method of claim 12 wherein the matrix comprises at least three reels.

15. The method of claim 12 wherein rows of symbols in adjacent reels are configured in an offset alignment relative to each other.

16. The method of claim 12 wherein the accessible symbols are positioned at an outside periphery of the matrix and are not adjacent to any other symbol along any portion of at least one side of a position.

17. The method of claim 12 wherein the game comprises a base game in which the operational steps of (iii) through (v) are performed as part of the base game.

18. The method of claim 12 wherein the game comprises a base game and a bonus game configured such that the operational steps of (iii) through (v) are performed as part of the bonus game.

19. The method of claim 12 wherein all accessible symbols in the second subgroup are removed in step (iv).

20. The method of claim 12 further wherein at least one accessible special symbol is included in the plurality of symbols that provides an automatically accessible zone for one or more of the symbols comprising: (a) the at least one accessible special symbol itself; (b) a symbol that is in a predefined position relative to the at least one accessible special symbol; (c) more than one symbol that are in predefined positions relative to the at least one accessible special symbol; or (d) any combination of (a), (b) and/or (c).

21. The method of claim 12 wherein at least one of the at least one first level winning combination of at least two symbols and the at least one second level winning combination of symbols results in any of the group comprising: (a) a multiplier applied to a win; (b) a free spin awarded; (c) extended play awarded; (d) a bonus awarded; or (e) any combination of (a), (b), (c) and/or (d).

22. The method of claim 12 wherein a special award is provided for eliminating all symbols in the matrix through successive rounds of play.

* * * * *